US006415119B2

(12) United States Patent
Nishimura et al.

(10) Patent No.: US 6,415,119 B2
(45) Date of Patent: Jul. 2, 2002

(54) PAPER POWDER COLLECTOR, PROCESS CARTRIDGE AND IMAGE FORMING APPARATUS

(75) Inventors: Soichiro Nishimura; Takeshi Fuwazaki, both of Nagoya; Kazushi Fukuta, Kariya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/817,170

(22) Filed: Mar. 27, 2001

(30) Foreign Application Priority Data

Mar. 27, 2000 (JP) ..... 2000-086083

(51) Int. Cl.[7] ..... G03G 21/00
(52) U.S. Cl. ..... 399/98; 399/111
(58) Field of Search ..... 399/98, 111, 113, 399/123, 127, 343, 349, 357, 358

(56) References Cited

U.S. PATENT DOCUMENTS

| | | | | |
|---|---|---|---|---|
| 5,436,700 A | * | 7/1995 | Kikuchi et al. | 399/111 |
| 6,041,203 A | * | 3/2000 | Suzuki et al. | 399/111 |
| 6,219,505 B1 | * | 4/2001 | Sato et al. | 399/98 |
| 6,266,499 B1 | * | 7/2001 | Murata et al. | 399/98 |

FOREIGN PATENT DOCUMENTS

| | | | |
|---|---|---|---|
| JP | 61-039080 | * | 2/1986 |
| JP | 62-075693 | * | 4/1987 |
| JP | 62-279381 | * | 12/1987 |
| JP | 04-089733 | * | 3/1992 |
| JP | 04-250485 | * | 9/1992 |
| JP | 05-197316 | * | 8/1993 |
| JP | 06-161169 | * | 6/1994 |
| JP | 06-211374 | * | 8/1994 |
| JP | 06-332345 | * | 12/1994 |

* cited by examiner

*Primary Examiner*—Sophia S. Chen
(74) *Attorney, Agent, or Firm*—Oliff & Berridge, PLC

(57) ABSTRACT

An image forming apparatus includes a casing 2 and a process cartridge 20, which is mounted removably in the casing. A powder retaining box 53 is supported pivotally by the bottom of the process cartridge 20, and supports a pinch roller 52 for contacting with a sheet of paper 3 to collect paper powder from it. The retaining box 53 has an opening through which the collected powder enters it. The pinch roller 52 substantially closes the box opening, and prevents the paper powder in the retaining box 53 from scattering out when the process cartridge 20 is dismounted from the casing 2. If the a retaining box 53 were fixed to the process cartridge 20, and the pinch roller 52 moved relative to the retaining box when the process cartridge is dismounted, paper powder might scatter out of the retaining box.

15 Claims, 2 Drawing Sheets

PAPER POWDER COLLECTOR, PROCESS CARTRIDGE AND IMAGE FORMING APPARATUS

BACKGROUND OF THE INVENTION

1. Field of the Invention

The present invention relates to a paper powder collector, a process cartridge and an image forming apparatus such as a laser printer.

2. Description of the Related Art

A laser printer or another image forming apparatus is fitted with a removable process cartridge which is removably mounted on a body of the image forming apparatus. This cartridge includes a toner container which contains toner, a developing roller which holds toner, and a photoconductor drum. As the photoconductor drum rotates, its cylindrical surface is evenly charged by an electrostatic charger. The laser printer also includes a scanner which emits a laser beam representing image data. The scanner scans the charged drum surface with the laser beam at high speed to form an electrostatic latent image on this surface. The formed latent image is developed by the toner on the developing roller to form a visible image on the photoconductor drum.

The laser printer includes a feed tray. While the paper fed from the feed tray passes between the photoconductor drum and a transfer roller, the visible image on the drum is transferred onto the paper.

The paper fed from the feed tray normally has paper powder adhering to it. Therefore, in order to ensure the creation of a high-grade image, the laser printer includes a paper powder collector for removing paper powder from the paper. The powder collector includes a powder collecting roller and a powder reservoir. The collecting roller is positioned in the paper path between the feed tray and the photoconductor drum to remove the paper powder from the paper in contact with this roller. The collected powder is retained in the powder reservoir. It may be desirable that the collecting roller be movable, or adjustable.

For example, the process cartridge of a laser printer of this type may include a paper powder collector, which can be attached to and detached from the printer together with this cartridge. The laser printer includes a drive roller supported by a shaft fixed to the printer frame. It is desirable that, when the process cartridge is mounted in the laser printer, the powder collecting roller of the powder collector engages with the drive roller to remove paper powder from the paper being fed between the rollers. In order to properly position the collecting roller relative to the drive roller, it is preferable that the collecting roller be movable to some extent when the process cartridge is mounted or removed. If the collecting roller is movable, however, the paper powder collected by this roller may scatter from the powder reservoir of the powder collector when the process cartridge is removed. This will dust the inside of the laser printer with paper powder.

SUMMARY OF THE INVENTION

It is an object of the present invention to provide a paper powder collector including a movable powder collecting roller and a powder reservoir, and ensuring that the paper powder collected by the roller does not scatter from the reservoir. It is another object to provide a process cartridge and an image forming apparatus each including such a paper powder collector.

In accordance with a first aspect of the present invention, a process cartridge is provided which is removably fitted to an image forming apparatus. The process cartridge includes a cartridge body and a paper powder collector for collecting paper powder on a record medium passing for image formation thereon in the image forming apparatus. The powder collector includes a powder collecting roller having a cylindrical surface for contacting with the record medium to collect paper powder on the medium. The powder collector also includes a powder reservoir for retaining the collected powder. The powder reservoir has an opening through which the collected powder enters the reservoir and which is substantially covered by the collecting roller. The collecting roller and the powder reservoir are movable together relative to the cartridge body when the cartridge is fitted to or removed from the image forming apparatus.

When the process cartridge is fitted to and removed from the image forming apparatus, the collecting roller and the powder reservoir move together relative to the cartridge body. Consequently, the paper powder collected by the collecting roller is kept from scattering out of the powder reservoir when the roller moves. Accordingly, the collecting roller can be securely positioned relative to the image forming apparatus, while the collected powder can be retained in the powder reservoir without scattering. When the process cartridge is removed from the image forming apparatus, the powder reservoir can be replaced with a new one. This facilitates the maintenance of the process cartridge.

The powder collector may further include a friction member contacting frictionally with the cylindrical surface of the collecting roller to charge the roller surface. The charged surface can effectively collect paper powder. The friction member and the collecting roller can move together relative to the image forming apparatus. This realizes always-stable frictional charging or electrification.

The friction member may be a sponge, which improves the charging of the roller surface, making the collection of paper powder more effective. The sponge may be made of urethane foam, which improves the charging of the roller surface and the durability of the friction member.

The powder collector may further include a scraper contacting with the cylindrical surface of the collecting roller to scrape the paper powder off the roller surface before the powder contacts with the friction member. The scraped powder is securely retained in the powder reservoir without entering the friction member. This prevents the friction member effectively from being deteriorated by paper powder entering it. It is consequently possible to realize stable frictional charging for a long time. The scraper and the collecting roller can move together relative to the image forming apparatus.

The scraper may include a flexible member in contact with the cylindrical surface of the collecting roller. The flexible member can closely contact with the collecting roller so as to more effectively scrape off the paper powder collected by the roller.

The cylindrical surface of the collecting roller may be coated with a layer containing fluorine, which improves the charging of the roller surface, making the collection of paper powder more effective.

The collecting roller may include a shaft grounded for stable charging of the cylindrical surface of this roller.

The powder reservoir may be pivotable relative to the image forming apparatus, and support the collecting roller. This simple mechanism makes it possible to move the collecting roller and the powder reservoir together.

In accordance with a second aspect of the present invention, an image forming apparatus is provided which includes a process cartridge which can be fitted thereto and removed therefrom and paper powder collector which is supported on the cartridge and collects paper powder on a record medium passing for image formation thereon in the image forming apparatus. The powder collector includes a powder collecting roller having a cylindrical surface for contacting with the record medium to collect paper powder on the medium. The powder collector also includes a powder reservoir for retaining the collected powder. The powder reservoir has an opening through which the collected powder enters the reservoir. The collecting roller substantially covers the reservoir opening. The collecting roller and the powder reservoir can move together relative to the cartridge.

The collecting roller can be securely positioned relative to the image forming apparatus, while the paper powder collected by the collecting roller can be securely retained in the powder reservoir without scattering. This prevents the inside of the image forming apparatus effectively from being dusted with scattering paper powder.

The image forming apparatus may further include a drive roller having a cylindrical surface for contacting with the cylindrical surface of the collecting roller when the process cartridge is fitted to the image forming apparatus. The drive roller is mounted in the image forming apparatus. The image forming apparatus may further include a pressing member for pressing the collecting roller against the drive roller when the process cartridge is fitted to the image forming apparatus. When the process cartridge is fitted to the image forming apparatus, the pressing member securely positions the collecting roller relative to the drive roller. Consequently, the collecting roller is kept in a good position in collecting paper powder on the record medium. It is therefore possible to remove paper powder stably.

The image forming apparatus may include a guide which is provided on a casing of the apparatus and guides the cartridge when the process cartridge is fitted to the image forming apparatus.

In accordance with a third aspect of the present invention, a paper powder collector is provided for collecting paper powder on a record medium for image formation. This powder collector includes a powder collecting roller for contacting with the record medium to collect the paper powder on the medium. The powder collector also includes a scraper for scraping off the collected powder. The scraper includes a flexible member in contact with the collecting roller. The powder collector further includes a powder reservoir for retaining the scraped powder.

While the collecting roller is rotating in contact with the record medium, the roller collects paper powder on the medium. The collected powder is scraped off by the scraper. The scraped powder is retained in the powder reservoir. Consequently, paper powder can be collected effectively by the collecting roller, and the collected powder can be retained effectively in the powder reservoir. The flexible member of the scraper can be in close contact with the collecting roller so as to effectively scrape off the collected powder.

In accordance with a fourth aspect of the present invention, another image forming apparatus is provided which includes a paper powder collector for collecting paper powder on a record medium passing for image formation in the image forming apparatus. The powder collector includes a powder collecting roller for contacting with the record medium to collect the paper powder on the medium. The powder collector also includes a scraper for scraping off the collected powder. The scraper includes a flexible member in contact with the collecting roller. The powder collector further includes a powder reservoir for retaining the scraped powder.

Paper powder can be collected effectively from the record medium by the collecting roller, and the collected powder can be retained effectively in the powder reservoir. This makes it possible to form a fine image on the record medium without paper powder.

The apparatus may further include a process cartridge which is removably fitted to the apparatus and on which the paper powder collector is provided. When the process cartridge is removed from the image forming apparatus, the powder reservoir can be replaced with a new one. This facilitates the maintenance of the process cartridge.

BRIEF DESCRIPTION OF THE DRAWINGS

A preferred embodiment of the present invention will be described below with reference to the accompanying drawings, in which.

DETAILED DESCRIPTION OF THE PREFERRED EMBODIMENT

Figure 1:
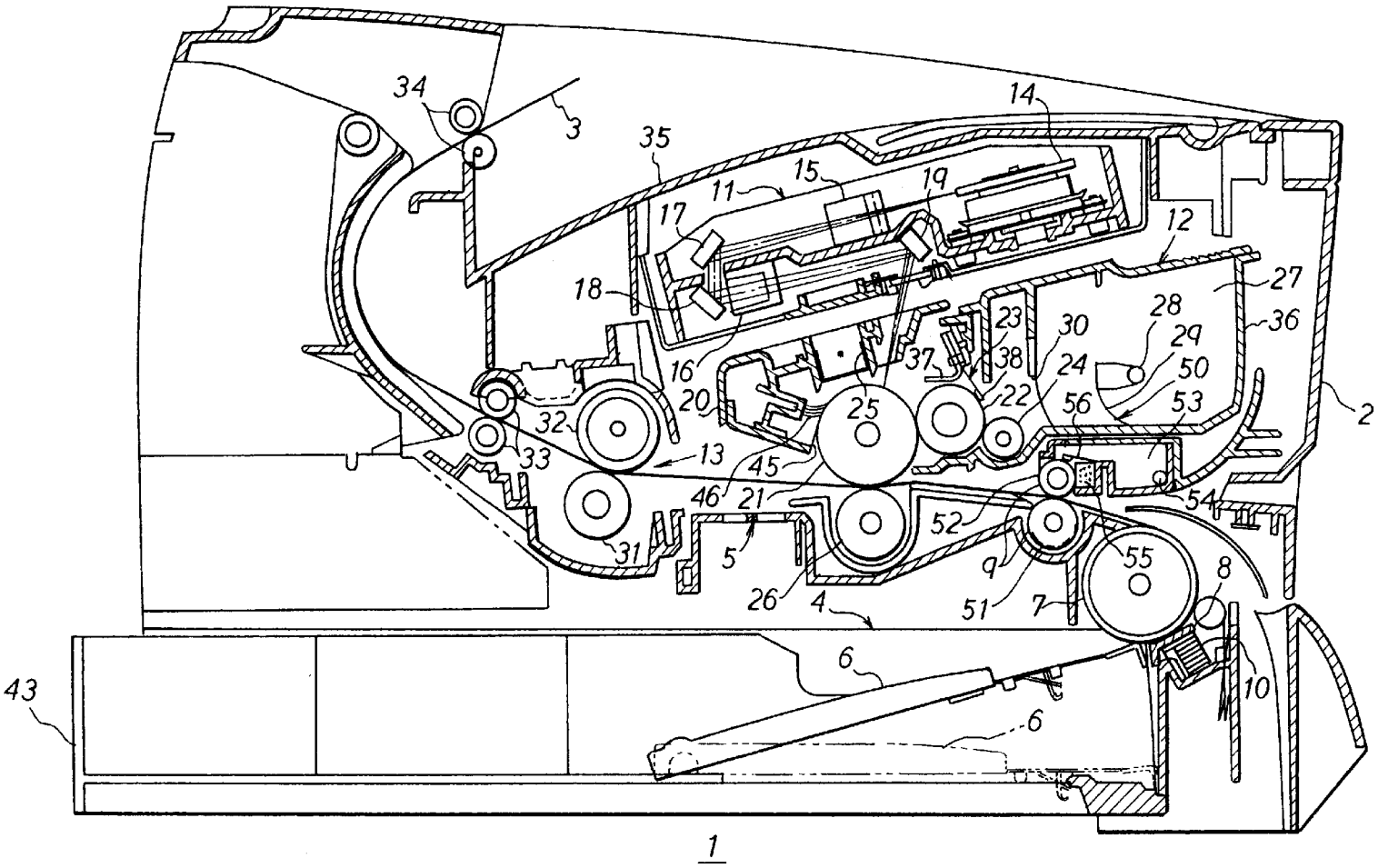
FIG. 1 is a side view partially in cross section of a laser printer embodying the present invention.

With reference to FIG. 1, a laser printer 1 includes a casing 2, which houses a feeder unit 4 for feeding a sheet of paper 3 as a record medium. The printer casing 2 also houses an image forming unit 5 for forming an image on the fed sheet 3.

The feeder unit 4 includes a feed tray 43 fitted removably in the bottom of the printer casing 2. The feeder unit 4 also includes a feed roller 7 and a feed pad 8 which are supported at one end of the feed tray 43. The feeder unit 4 further includes registration rollers 9 supported downstream from the feed roller 7 in the paper path.

The feed tray 43 includes a pressure plate 6 provided in it, which can be stacked with sheets of paper. One end of the pressure plate 6 is supported by the bottom of the feed tray 43 so that this plate can pivot. A compression spring (not shown) urges the other end of the pressure plate 6 upward so that the top sheet of paper on this plate comes in compressive contact with the feed roller 7. As the paper sheets on the pressure plate 6 increase in number, its urged end moves downward against the force of the compression spring. The feed pad 8 is urged against the feed roller 7 by a compression spring 10. The rotation of the feed roller 7 causes a sheet of paper 3 to be pinched between this roller and the feed pad 8 and then fed toward the registration rollers 9.

The registration rollers 9 include a feed roller 51 as a drive roller and a pinch roller 52 as a powder collecting roller. The feed roller 51 is supported rotatably by the printer casing 2, and can be driven by the torque transmitted from a motor (not shown). As will be stated later on in detail, the pinch roller 52 forms part of a paper powder collecting unit 50. The pinch roller 52 is supported rotatably by a process cartridge 20. When the process cartridge 20 is mounted in the printer casing 2, the cylindrical surfaces of the pinch roller 52 and feed roller 51 are in contact with each other. The registration rollers 9 register the sheet of paper 3 fed from the feed roller 7, and feed the registered sheet to the image forming unit 5. The image forming unit 5 includes a scanner unit 11, a developing unit 12 and a fixing unit 13.

The scanner unit 11 is provided in an upper portion of the printer casing 2, and includes a laser beam emitter (not shown), a polygonal mirror 14 which can be rotated, lenses 15 and 16, and reflecting mirrors 17, 18 and 19. The scanner unit 11 emits laser beams based on image data and emitted from the laser beam emitter. As indicated with a chain line in FIG. 1, the emitted beams are reflected by the polygonal mirror 14, pass through the lens 15, are reflected by the reflectors 17 and 18, pass through the lens 16 and are reflected by the reflector 19. The process cartridge 20 includes a photoconductor drum 21 having a cylindrical surface, which is scanned with the finally reflected beams at high speed.

The developing unit 12 is positioned under or below the scanner unit 11, and fitted with the process cartridge 20. The process cartridge 20 is mounted removably in the printer casing 2.

Figure 2:
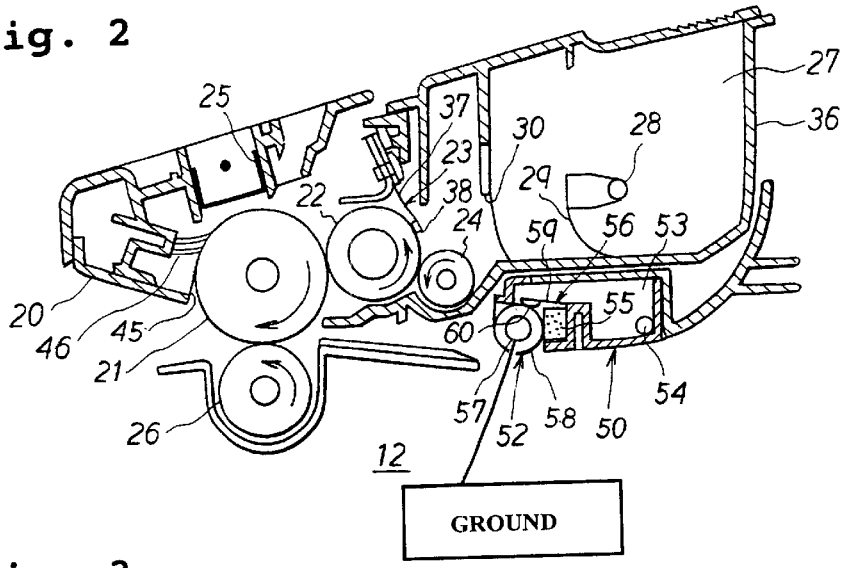
FIG. 2 is an enlarged side view partially in cross section of the process cartridge of the laser printer as shown in FIG. 1.

With reference to FIG. 2, the process cartridge 20 is fitted with the photoconductor drum 21, a scorotron charger 25, a developing cartridge 36, a transfer roller 26 and the powder collecting unit 50. The developing cartridge 36 is fitted removably to the process cartridge 20. Provided in the developing cartridge 36 are a developing roller 22, a layer thickness regulation blade 23, a supply roller 24 and a toner box 27.

The toner box 27 is filled with toner as a developer, which is a positively chargeable and non-magnetic single component type toner. The toner is a polymerized toner composed by a known polymerizing method like suspension polymerization, which involves copolymerizing a styrene monomer such as styrene monomer and an acrylic monomer such as acrylic acid, alkyl (C1–C4) acrylate, alkyl (C1–C4) methacrylate.

The toner box 27 houses an agitator 29 supported by a rotating shaft 28, which extends at the center of the box 27. The agitator 29 agitates the toner in the toner box 27. The agitated toner is released from the supply port 30 of the toner box 27. The agitator 29 is made of polyethylene terephthalate film or other flexible film, and can be rotated with its free end in contact with inner walls of the toner box 27.

The supply roller 24 is supported in front of the supply port 30, and can rotate counterclockwise in FIG. 2. The supply roller 24 is in somewhat compressive contact with the developing roller 22, which can rotate counterclockwise in FIG. 2.

The supply roller 24 includes a metallic shaft, which is covered with a cylindrical member made of electrically conductive foamed material. The developing roller 22 includes a metallic shaft, which is covered with a cylindrical member made of electrically conductive rubber. More specifically, the cylindrical member of the developing roller 22 includes a body made of electrically conductive urethane rubber or silicone rubber which may contain fine particles of carbon. The body is coated with a layer of urethane rubber which contains fluorine or silicone rubber. A developing bias voltage is applied to the developing roller 22 relative to the photoconductor drum 21.

The layer thickness regulation blade 23 includes a metallic plate spring 37, one end of which is supported near the developing roller 22 by the developing cartridge 36. The regulation blade 23 also includes a presser 38 fixed to the other end of the plate spring 37. The presser 38 is made of insulating silicone rubber and has a semicircular shape. The elastic force of the plate spring 37 keeps the presser 38 in compressive contact with the developing roller 22.

While the toner released from the supply port 30 is supplied by the rotation of the supply roller 24 to the developing roller 22, the toner is charged positively by friction between the rollers 24 and 22. While the developing roller 22 is rotating, the toner on it is charged sufficiently by friction between it and the presser 38. The sufficiently charged toner is held as a thin layer of fixed thickness on the cylindrical surface of the developing roller 22.

The photoconductor drum 21 is supported so as to rotate clockwise in FIG. 2, with its cylindrical surface in contact with the cylindrical surface of the developing roller 22. The photoconductor drum 21 includes a grounded body, and its cylindrical surface is covered with a positively chargeable photosensitive layer, which may be made of polycarbonate.

The scorotron charger 25 is spaced upward from and out of contact with the photoconductor drum 21. The scorotron charger 25 is a charger for positive electrification, which can evenly positively charge the cylindrical surface of the photoconductor drum 21. This charger 25 includes a charging wire, which may be made of tungsten, for discharging a corona.

The evenly positively charged surface of the photoconductor drum 21 is scanned at high speed with the laser beams from the scanner unit 11 so that portions of the charged surface are exposed to form an electrostatic latent image based on the image data. The exposed portions have a lower electric potential. While the developing roller 22 is rotating in contact with the photoconductor drum 21, part of the positively charged toner on the roller 22 is transferred to the latent image, where it is held to form a visible image, effecting an inversion.

The transfer roller 26 is supported by the printer casing 2 (FIG. 1) so as to rotate counterclockwise in FIG. 2. When the process cartridge 20 is mounted in the printer casing 2, the cylindrical surfaces of the transfer roller 26 and photoconductor drum 21 are in contact with each other. The transfer roller 26 includes a metallic shaft, which is covered with a cylindrical member made of electrically conductive rubber. A transfer bias is applied to the transfer roller 26 relative to the photoconductor drum 21 so that the visible image on the drum 21 is transferred to a sheet of paper 3 passing between the drum 21 and roller 26.

The process cartridge 20 includes a lower film 45 for uniformizing the potential of the cylindrical surface of the photoconductor drum 21 from which a visible image has been transferred. The lower film 45 is supported in contact with the cylindrical surface of the photoconductor drum 21, and positioned downstream in the direction of rotation of the drum 21 from the transfer roller 26, but upstream in this direction from the scorotron charger 25. The process cartridge 20 also includes an electrically conductive brush 46 for collecting the paper powder sticking to the cylindrical surface of the photoconductor drum 21 from which a visible image has been transferred. The conductive brush 46 is supported in contact with the cylindrical surface of the photoconductor drum 21, and positioned between the lower film 45 and scorotron charger 25.

As shown in FIG. 1, the fixing unit 13 includes a heating roller 32 supported downstream from the developing unit 12 in the paper path. The fixing unit 13 also includes a pressing roller 31 pressed against the heating roller 32. The fixing unit 13 further includes a pair of conveying rollers 33 supported downstream from the rollers 31 and 32 in the paper path. The heating roller 32 is metallic and fitted with a heating halogen lamp. While a sheet of paper 3 is passing between the heating roller 32 and the pressing roller 31, the heating roller 32 thermally fixes the toner transferred to the sheet 3 in the developing unit 12. Subsequently, the conveying rollers 33 convey the sheet 3 to a pair of discharge rollers 34, which discharge the sheet 3 onto a discharge tray 35.

The paper powder collecting unit 50 is positioned at the bottom of the developing cartridge 36 and supported pivotally by the process cartridge 20. The collecting unit 50 includes a powder retaining box 53 as a powder reservoir, which is supported at one end pivotally by a pivot shaft 54 on the process cartridge 20. The other end of the retaining box 53 is positioned nearer to the photoconductor drum 21 than the pivot shaft 54 when the process cartridge 20 is mounted in the printer casing 2. The retaining box 53 is rectangular in cross section, and one of its longer sides is open. When the process cartridge 20 is mounted, the open side of the retaining box 53 is positioned just under the flat bottom of the toner box 27.

Supported in the powder retaining box 53 is the pinch roller 52 as the powder collecting roller for contact with a sheet of paper 3. The retaining box 53 houses a sponge 55 as a friction member in frictional contact with the cylindrical surface of the pinch roller 52. The retaining box 53 also houses a scraper 56 for scraping paper powder off the pinch roller 52. The scraper 56 is supported in contact with the cylindrical surface of the pinch roller 52, and positioned upstream from the sponge 55 in the direction of rotation of the pinch roller 52.

The pinch roller 52 is supported rotatably on the free end of the powder retaining box 53. The bottom of the powder retaining box 53 has an opening, where part of the pinch roller 52 is positioned. When the process cartridge 20 is mounted in the printer casing 2, the pinch roller 52 is positioned in contact with the feed roller 51. Thus, this simple structure enables the powder retaining box 53 to move together with the pinch roller 52 around the pivot shaft 54.

The pinch roller 52 includes a metallic shaft 57, which is covered with a cylindrical member 58 made of electrically conductive rubber. The cylindrical surface of the cylindrical member 58 is coated with a layer of urethane rubber which contains fluorine or silicone rubber. The friction between this layer and the sponge 55 makes it possible to charge the cylindrical surface of the pinch roller 52 more effectively. The roller shaft 57 is grounded so that the cylindrical surface of the pinch roller 52 can be charged more stably.

The sponge 55 is roughly rectangular, and it is positioned on that side of the pinch roller 52 which is away from the photoconductor drum 21 when the process cartridge 20 is mounted. The sponge 55 is in frictional contact with the cylindrical surface of the pinch roller 52 so as to charge this surface. Sponge is effective for the electrification of the pinch roller 52. The sponge 55 is made of urethane foam, which is more effective for the electrification of the pinch roller 52, and which improves the durability of the sponge 55.

The scraper 56 takes the form of a plate, and is positioned over the sponge 55 in such a manner that one end of this scraper is in contact with the cylindrical surface of the pinch roller 52. The scraper 56 includes a polyethylene terephthalate film 59 and a flexible member 60, which is fixed to one end of the film, and which may be made of non-woven fabric. The flexible member 60 is in contact with the surface of the pinch roller 52 so as to scrape paper powder off the roller surface. Such a flexible member can be in closer contact with the pinch roller 52 so as to more effectively scrape the paper powder collected by this roller.

A sheet of paper 3 fed from the feed roller 7 is registered between the pinch roller 52 and the feed roller 51, and then fed to the image forming unit 5. While the sheet 3 is registered and fed, the pinch roller 52 in contact with it collects paper powder on it. As the pinch roller 52 rotates, the scraper 56 scrapes off the collected powder. The scraped powder is retained in the retaining box 53. As the pinch roller 52 rotates in frictional contact with the sponge 55, the cylindrical surface of this roller is well charged. The charged surface contacts with the sheet 3 and collects paper powder from it. This series of operations is repeated.

Because the cylindrical surface of the pinch roller 52 is charged in frictional contact with the sponge 55, this roller surface can well catch paper powder. The scraper 56 scrapes off the caught powder before the powder comes in contact with the sponge 55. The scraped powder can be retained effectively in the retaining box 53. This prevents the sponge 55 effectively from being deteriorated by paper powder entering it. It is consequently possible to provide stable frictional electrification for a long time.

Figure 3:
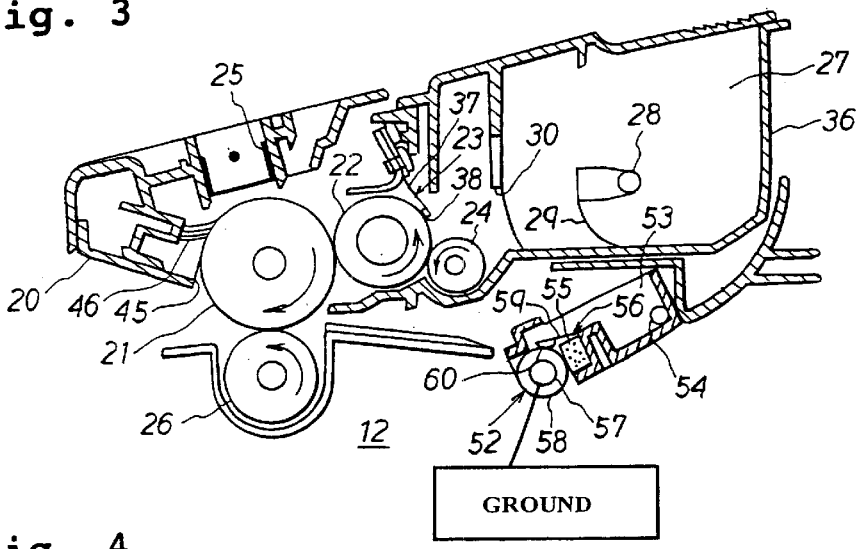
FIG. 3 is an enlarged side view partially in cross section of the process cartridge removed from the printer casing.

The paper powder collecting unit 50 is supported pivotally at one end on the pivot shaft 54. When the process cartridge 20 is removed from the printer casing 2, as shown in FIG. 3, the other end of the collecting unit 50 moves down. The retaining box 53 has a protruding stopper (not shown), which engages with the process cartridge 20 to keep the collecting unit 50 from further pivoting counterclockwise in FIG. 3 from a predetermined angle to this cartridge.

When the process cartridge 20 is mounted in the printer casing 2, as shown in FIG. 1, the pinch roller 52, which is supported by the retaining box 53, is positioned securely with its cylindrical surface in contact with the cylindrical surface of the feed roller 51, which is supported by the printer casing 2. This enables the rollers 51 and 52 to feed a sheet of paper 3 securely between them, and the pinch roller 52 to catch the paper powder securely from the sheet.

Figure 4:
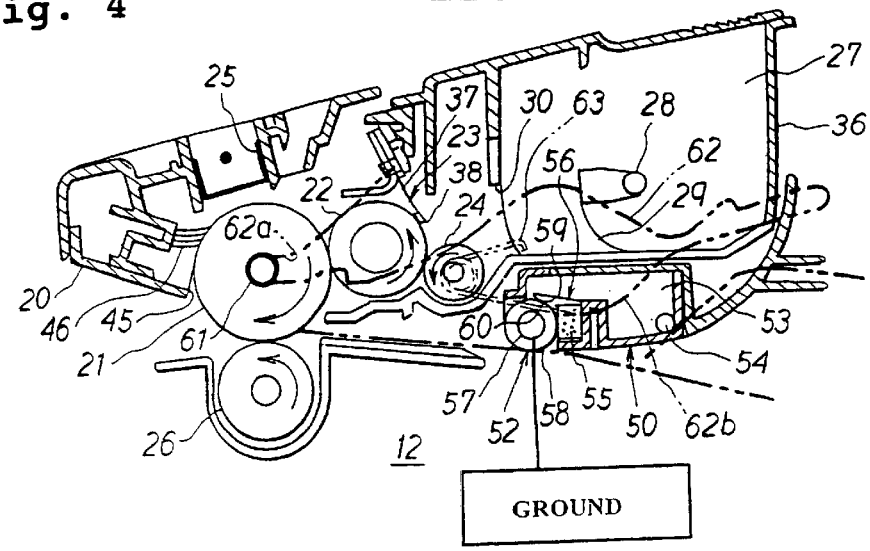
FIG. 4 is a side view partially in cross section showing how the process cartridge is mounted in the printer casing.

As shown in FIG. 4, the process cartridge 20 includes guide protrusions 61, while the printer casing 2 has guide grooves 62, which are guide grooves 62*a* and 62*b*, for guiding the protrusions 61 so that the cartridge 20 can be mounted in a good position. The guide protrusions 61 protrude coaxially with the photoconductor drum 21 because it is necessary to position this drum with precision relative to the scanner unit 11.

When the process cartridge 20 is inserted into the printer casing 2, the guide protrusions 61 are guided by the guide grooves 62*a* and reach their closed ends. This positions the photoconductor drum 21 precisely and securely. In the meantime, the other guide grooves 62*b* guide the shaft 57 of the pinch roller 52 so as to move the free end of the retaining box 53 upward. As shown in FIG. 1, the pinch roller 52 is positioned with its cylindrical surface in contact with the cylindrical surface of the feed roller 51.

The printer casing 2 is fitted with a compression spring 63, which engages with the pinch roller 52 and urges it downward against the feed roller 51 when the process cartridge 20 is mounted in the casing 2. This makes it possible to securely position the pinch roller 52 relative to the feed roller 51. Consequently, the pinch roller 52 is kept in a good position in catching paper powder on the sheet 3. It is therefore possible to remove paper powder stably.

The process cartridge 20 can be removed from the printer casing 2 by being simply pulled out of it. During which the process cartridge 20 is pulled out, its guide protrusions 61 are guided by the guide grooves 62*a*. When the shaft 57 of the pinch roller 52 is removed from the guide grooves 62*b* so that the free end of the retaining box 53 moves downward as shown in FIG. 3.

When the process cartridge 20 is mounted in and removed from the printer casing 2, the retaining box 53 moves together with the pinch roller 52 around the pivot shaft 54. If the retaining box 53 were fixed and, during the removal of the process cartridge 20, the pinch roller 52 moved relative to the regaining box 53, as was the case with the conventional image forming apparatus, paper powder might scatter out of the retaining box 53. This would dust the inside of the printer casing 2 with paper powder. It is therefore possible to position the process cartridge 20, especially the photoconductor drum 21, precisely and securely for good image formation, and position the pinch roller 52 for stable power removal, while it is possible to retain securely in the retaining box 53 the paper powder caught by the pinch roller 52.

When the process cartridge 20 is mounted and removed, the sponge 55 moves together with the pinch roller 52. Consequently, the relative positions of the sponge 55 and pinch roller 52 are maintained for stable frictional electrification of this roller.

When the process cartridge 20 is removed from the printer casing 2, it is possible to replace the powder collecting unit 50 with a new one. This facilitates the maintenance of the printer.

As stated earlier on, the powder collecting unit 50 is provided pivotally relative to the process cartridge 20. Alternatively, the collecting unit 50 might be positioned over the feed roller 7 and pivot relative to the printer casing 2. In the above-embodiment, the transfer roller 26 has been provided on the process cartridge 20. However, the transfer roller 26 may be provided on the casing of the printer casing 2 rather than the process cartridge 20.

In the above-embodiment, the developing cartridge 36 is removable from the process cartridge 20. However, the developing cartridge 36 may be structured such as to be integrally fixed to the process cartridge 20.

What is claimed is:

1. A process cartridge which is removably fitted to an image forming apparatus, the process cartridge comprising:

a cartridge body; and a paper powder collector for collecting paper powder on a record medium passing for image formation thereon in the image forming apparatus, the powder collector including;

a powder collecting roller having a cylindrical surface for contacting with the record medium to collect paper powder on the record medium, and a powder reservoir for retaining the collected powder, the powder reservoir having an opening through which the collected powder enters the powder reservoir and which is substantially covered by the collecting roller, wherein the collecting roller and the powder reservoir are movable together relative to the cartridge body when the process cartridge is fitted to or removed from the image forming apparatus.

2. The process cartridge according to claim 1, wherein the paper powder collector further comprises a friction member contacting frictionally with the cylindrical surface of the collecting roller to charge the surface, the friction member and the collecting roller being movable together relative to the cartridge body.

3. The process cartridge according to claim 2, wherein the friction member is a sponge.

4. The process cartridge according to claim 3, wherein the sponge is made of urethane foam.

5. The process cartridge according to claim 2, wherein the paper powder collector further comprises a scraper contacting with the cylindrical surface of the collecting roller to scrape the paper powder off the cylindrical surface before the powder contacts with the friction member, the scraper and the collecting roller being movable together relative to the cartridge body.

6. The process cartridge according to claim 5, wherein the scraper includes a flexible member in contact with the cylindrical surface of the collecting roller.

7. The process cartridge according to claim 2, wherein the cylindrical surface charged by the friction member collects the paper powder.

8. The process cartridge according to claim 1, wherein the cylindrical surface of the collecting roller is coated with a layer containing fluorine.

9. The process cartridge according to claim 1, wherein the collecting roller includes a grounded shaft.

10. The process cartridge according to claim 1, wherein the powder reservoir is pivotable about an axis provided on the cartridge body.

11. The process cartridge according to claim 1, wherein the image forming apparatus has a driving roller and a pressing member, and the collecting roller is pressed against the driving roller by a pressing force of the pressing member when the process cartridge is fitted to the image forming apparatus.

12. An image forming apparatus comprising:

a process cartridge which is removably fitted to an image forming apparatus;

a paper powder collector which is supported on the process cartridge and collects paper powder on a record medium passing for image formation thereon in the image forming apparatus;

the powder collector including;

a powder collecting roller having a cylindrical surface for contacting with the record medium to collect paper powder on the record medium, and a powder reservoir for retaining the collected powder, the powder reservoir having an opening through which the collected powder enters the powder reservoir and which is substantially covered by the collecting roller, wherein the collecting roller and the powder reservoir are movable together relative to the process cartridge when the process cartridge is fitted to or removed from the image forming apparatus.

13. The image forming apparatus according to claim 12, further comprising:

a drive roller having a cylindrical surface for contacting with the cylindrical surface of the collecting roller when the process cartridge is fitted to the image forming apparatus; and a pressing member for pressing the collecting roller against the drive roller when the process cartridge is fitted to the image forming apparatus.

14. The image forming apparatus according to claim 12, further comprising a guide which is provided in a casing of the image forming apparatus and guides the cartridge when the process cartridge is fitted to the image forming apparatus.

15. The image forming apparatus according to claim 12, wherein the powder reservoir is pivotable about an axis provided on the cartridge.

* * * * *